US010997926B2

(12) United States Patent
Park et al.

(10) Patent No.: US 10,997,926 B2
(45) Date of Patent: May 4, 2021

(54) DRIVING CONTROLLER, DISPLAY DEVICE AND DRIVING METHOD INCLUDING A LOWER FREQUENCY MODE AND AN IMAGE TRANSITION MODE

(71) Applicant: SAMSUNG DISPLAY CO., LTD., Yongin-si (KR)

(72) Inventors: Geunjeong Park, Hwaseong-si (KR); Eunho Lee, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/726,464

(22) Filed: Dec. 24, 2019

(65) Prior Publication Data

US 2020/0211475 A1 Jul. 2, 2020

(30) Foreign Application Priority Data

Dec. 27, 2018 (KR) ..... 10-2018-0170974

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2310/027* (2013.01)

(58) Field of Classification Search
CPC ..... G09G 3/3291; G09G 3/3266
See application file for complete search history.

(56) References Cited

U.S. PATENT DOCUMENTS

| | | | | |
|---|---|---|---|---|
| 9,607,562 | B2 * | 3/2017 | Kim | G09G 3/3614 |
| 9,657,062 | B2 * | 5/2017 | Larsen | A61P 1/04 |
| 10,157,574 | B2 * | 12/2018 | Park | G09G 3/3275 |
| 2007/0046587 | A1 * | 3/2007 | Takahara | G09G 3/3233 345/76 |
| 2014/0184653 | A1 * | 7/2014 | Park | G06T 5/002 345/690 |
| 2020/0211475 | A1 * | 7/2020 | Park | G09G 3/3266 |

FOREIGN PATENT DOCUMENTS

| | | |
|---|---|---|
| KR | 10-2016-0078596 | 7/2016 |
| KR | 10-2017-0060662 | 6/2017 |

* cited by examiner

*Primary Examiner* — Chun-Nan Lin
(74) *Attorney, Agent, or Firm* — F. Chau & Associates, LLC

(57) ABSTRACT

A driving controller includes an image conversion circuit configured to convert an image signal to an image data signal including active data and blank data, a still image determination circuit configured to output a flag signal of an active level when the image signal is a still image, an operation mode determination circuit configured to output an operation mode signal indicating a low frequency mode when the flag signal is the active level, and to output an operation mode signal indicating an image transition mode when the flag signal is changed from the active level and an inactive level, and a blank voltage determination circuit configured to output a blank voltage signal corresponding to a first gray scale during the low frequency mode, and a blank voltage signal corresponding to a second gray scale during the transition mode, wherein the blank data corresponds to the blank voltage signal.

20 Claims, 12 Drawing Sheets

DRIVING CONTROLLER, DISPLAY DEVICE AND DRIVING METHOD INCLUDING A LOWER FREQUENCY MODE AND AN IMAGE TRANSITION MODE

CROSS-REFERENCE TO RELATED APPLICATIONS

This U.S. non-provisional patent application claims priority under 35 U.S.C. § 119 of Korean Patent Application No. 10-2018-0170974, filed on Dec. 27, 2018, the entire contents of which are hereby incorporated by reference.

BACKGROUND

The present disclosure relates to a display device, and more particularly, to a display device including a driving controller having a low power consumption scheme.

An organic light emitting display device displays an image using an organic light emitting diode in which an electron and an electron hole are recombined, causing light to be emitted. It is advantageous for such an organic light emitting display device to have a rapid response speed and to be driven with a low power consumption.

An organic light emitting display device may have a plurality of pixels connected to data lines and scan lines. Each of the pixels includes an organic light emitting diode and a circuit unit for controlling the amount of current flowing through the organic light emitting diode. For example, the circuit unit may control the current flowing from a first driving voltage to a second driving voltage through the organic light emitting diode according to a data signal. Light of a desired luminance is then generated based on the current amount flowing through the organic light emitting diode.

A transistor included in the circuit unit may have a low-temperature polycrystalline silicon (LTPS) semiconductor layer. The LTPS transistor may have high mobility and stability, but may generate a leakage current when a voltage level of the second driving voltage is lowered, or when an operation frequency is lowered. When a leakage current is generated in the circuit unit, the amount of current flowing through the organic light emitting diode changes. This may reduce the quality of the display.

In order to reduce the leakage current in the circuit unit of a pixel, a transistor may incorporate an oxide semiconductor as the semiconductor layer. In some cases, the circuit unit of a pixel may include both an LTPS semiconductor transistor and an oxide semiconductor transistor.

SUMMARY

The present disclosure provides a driving controller and a display device including the same capable of reducing power consumption and improving display quality.

The present disclosure relates to a driving method of a display device capable of reducing power consumption and improving display quality.

An embodiment of the inventive concept provides a driving controller including: an image conversion circuit configured to convert an image signal received externally to an image data signal including active data and blank data; a still image determination circuit configured to output a flag signal of an active level, when the image signal is a still image; an operation mode determination circuit configured to output an operation mode signal indicating a low frequency mode, when the flag signal is the active level, and to output the operation mode signal indicating an image transition mode, when the flag signal is changed between the active level and an inactive level; and a blank voltage determination circuit configured to receive the operation mode signal, output a blank voltage signal corresponding to a first gray scale during the low frequency mode, and output the blank voltage signal corresponding to a second gray scale that is different from the first gray scale during the image transition mode, wherein the blank data corresponds to the blank voltage signal.

In an embodiment, the image conversion circuit may output the image data signal at a driving frequency corresponding to the operation mode signal.

In an embodiment, the driving frequency in the image transition mode may be higher than that in the low frequency mode.

In an embodiment, the operation mode determination circuit may output the operation mode signal indicating the image transition mode for a prescribed time, after the flag signal is changed from the active level to the inactive level, and may output the operation mode signal indicating the low frequency mode, when the flag signal is the active level after passage of the prescribed time.

In an embodiment, the first gray scale may be a black gray scale, and the second gray scale may be a white gray scale.

In an embodiment, the driving controller may further include: a control signal output circuit configured to output a first start control signal and a second start control signal in response to a control signal received externally and the operation mode signal.

In an embodiment, frequencies of the first start control signal and the second start control signal may be different from each other during the low frequency mode, and frequencies of the first start control signal and the second start control signal may be identical during the image transition mode.

In an embodiment of the inventive concept, a display device includes: a display panel including a plurality of pixels respectively connected to a plurality of data lines and a plurality of scan lines; a driving controller configured to receive an image signal and output an image data signal, a data control signal, and a scan control signal; a data driving circuit configured to drive the plurality of data lines in response to the image data signal and the data control signal; and a scan driving circuit configured to drive the plurality of scan lines in response to the scan control signal, wherein the driving controller includes: an image conversion circuit configured to convert an image signal received externally to an image data signal including active data and blank data; a still image determination circuit configured to output a flag signal of an active level, when the image signal is a still image; an operation mode determination circuit configured to output an operation mode signal indicating a low frequency mode, when the flag signal is the active level, and to output the operation mode signal indicating an image transition mode, when the flag signal is changed between the active level and an inactive level; and a blank voltage determination circuit configured to receive the operation mode signal, output a blank voltage signal corresponding to a first gray scale during the low frequency mode, and output the blank voltage signal corresponding to a second gray scale that is different from the first gray scale during the image transition mode, wherein the blank data corresponds to the blank voltage signal.

In an embodiment, the image conversion circuit may output the image data signal at a driving frequency corresponding to the operation mode signal.

In an embodiment, the driving frequency in the image transition mode may be higher than that in the low frequency mode.

In an embodiment, the operation mode determination circuit may output the operation mode signal indicating the image transition mode for a prescribed time after the flag signal is changed from the active level to the inactive level, and may output the operation mode signal indicating the low frequency mode, when the flag signal is the active level after passage of the prescribed time.

In an embodiment, the first gray scale may be a black gray scale, and the second gray scale may be a white gray scale.

In an embodiment, at least one of the plurality of pixels may include: a light emitting diode including an anode and a cathode; a first transistor including a first electrode configured to receive a first driving voltage, a second electrode electrically connected to the anode of the light emitting diode, and a gate electrode; a second transistor including a first electrode connected to a corresponding data line among the plurality of data lines, a second electrode connected to the first electrode of the first transistor, and a gate electrode configured to receive a first scan signal; and a third transistor including a first electrode connected to the second electrode of the first transistor, a second electrode connected to the gate electrode of the first transistor, and a gate electrode configured to receive a second scan signal.

In an embodiment, each of the first transistor and the second transistor may be a P-type transistor, and the third transistor may be an N-type transistor.

In an embodiment, the display device may further include: a control signal output circuit configured to output a first start control signal and a second start control signal in response to a control signal received externally and the operation mode signal, wherein the scan control signal includes the first start control signal and the second start control signal, and the scan driving circuit outputs a first scan signal for driving the first and second transistors in synchronization with the first start control signal, and outputs a second scan signal for driving the third transistor in synchronization with the second start control signal.

In an embodiment, frequencies of the first start control signal and the second start control signal may be different front each other during the low frequency mode, and the frequencies of the first start control signal and the second start control signal may be identical during the image transition mode.

In an embodiment, each of the first transistor and the second transistor may be a low-temperature polycrystalline silicon (LTPS) semiconductor transistor, and the third transistor may be an oxide semiconductor transistor.

In an embodiment of the inventive concept, a driving method of a display device includes: determining whether an image signal is a still image; outputting a flag signal of an active level, when the image signal is the still image; outputting an operation mode signal indicating a low frequency mode, when the flag signal is the active level; outputting the operation mode signal indicating an image transition mode, when the flag signal is changed from the active level to an inactive level; outputting a blank voltage signal corresponding to the operation mode signal; and converting an image signal received externally to an image data signal including active data and blank data in response to the operation mode signal and the blank voltage signal, wherein the blank voltage signal corresponds to a first gray scale during the low frequency mode, the blank voltage signal corresponds to a second gray scale that is different from the first gray scale during the image transition mode, and the blank data corresponds to the blank voltage signal.

In an embodiment, in the outputting of the operation mode signal, after the flag signal is changed from the active level to the inactive level, the operation mode signal indicating the image transition mode may be output for a prescribed time, and when the flag signal is the active level after passage of the prescribed time, the operation mode signal indicating the low frequency mode may be output.

In an embodiment, a driving frequency of the image transition mode may be higher than that of the low frequency mode, the first gray scale may be a black gray scale, and the second gray scale may be a white gray scale.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
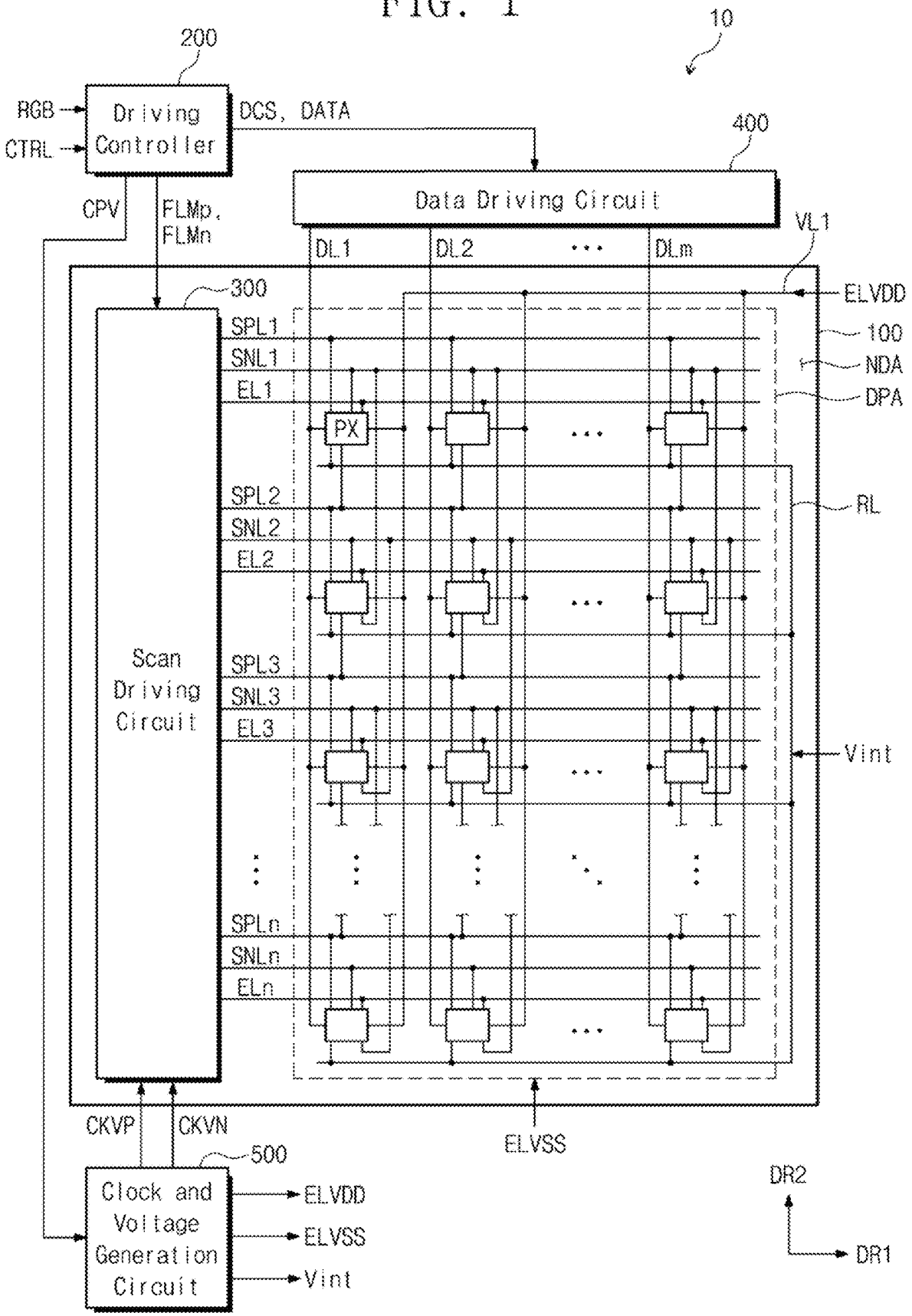
FIG. 1 is a block diagram of an organic light emitting display device according to an embodiment of the inventive concept.

Embodiments of the present disclosure relate to a display device having a driving controller that is configured to reduce power consumption by implementing a low frequency mode when the display panel shows a still image. In some cases, a transition mode is used during the transition between operating in the normal frequency mode and the low frequency mode. The transition mode may be associated with higher frequency and a different gray scale for blank data as compared to the low frequency mode. Utilizing the transition mode may reduce the occurrence of image artifacts such as an afterimage or an image flicker that may occur during the transition between modes.

Like reference numerals in the drawings refer to like elements. In addition, in the drawings, the thickness and the ratio and the dimension of the elements may be exaggerated for effective description of the technical contents. The term "and/or" includes any and all combinations of one or more of the associated items.

Terms such as first, second, and the like may be used to describe various components, but these components should not be limited by the terms. The terms are used only for the purpose of distinguishing one component from another component. For instance, a first component may be referred to as a second component, or similarly, a second component may be referred to as a first component, without departing from the scope of the present disclosure. The singular forms "a," "an" and "the" are intended to include the plural forms as well, unless the context clearly indicates otherwise.

In addition, the terms such as "under", "lower", "on", and "upper" are used for explaining associations of items illustrated in the drawings. It will be understood that the spatially relative terms are intended to encompass different orientations of the device in use or operation in addition to the orientation depicted in the figures.

Unless otherwise defined, all terms (including technical and scientific terms) used herein have the same meaning as commonly understood by one of ordinary skill in the art to which example embodiments belong. In addition, it will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be further understood that the terms "includes" and/or "including", when used in this specification, specify the presence of stated features, integers, steps, operations, elements, components or combinations thereof, but do not preclude the presence or addition of one or more other features, integers, steps, operations, elements, components, or combinations thereof.

Hereinafter, embodiments of the inventive concept will be described with reference to the accompanying drawings.

FIG. 1 is a block diagram of an organic light emitting display device according to an embodiment of the inventive concept.

With reference to FIG. 1, the organic light emitting display device 10 includes a display panel 100, a driving controller 200, a scan driving circuit 300, a data driving circuit 400, and a clock and voltage generation circuit 500.

According to embodiments of the present disclosure, the driving controller 200 may reduce power consumption by operating in a low frequency mode when it receives a still image, and may prevent an afterimage by operating in an image transition mode (with a higher driving frequency) when an image transition is detected in the low frequency mode. During a blank period in the image transition mode, a voltage level of the data signal may be changed to a white gray scale voltage level to minimize flicker.

The driving controller 200 receives an image signal RGB and a control signal CTRL, and converts the data format of the image signal RGB so as to be matched with an interface specification with the data driving circuit 400 to generate an image data signal DATA. The driving controller 200 outputs a scan control signal, a data control signal DCS, and a gate pulse signal CPV. The scan control signal may include a first start control signal FLMp and a second start control signal FLMn. In FIG. 1, the scan control signal only includes the first start control signal FLMp and the second start control signal FLMn, but the scan control signal may further include other signals.

The clock and voltage generation circuit 500 receives the gate pulse signal CPV from the driving controller 200, and generates voltages and clock signals for operations of the organic light emitting display device 10. In the embodiment, the clock and voltage generation circuit 500 generates a first driving voltage ELVDD, a second driving voltage ELVSS, an initialization voltage Vint, a first gate clock signal CKVP, and a second gate clock signal CKVN, but the embodiment is not limited thereto. For example, the clock and voltage generation circuit 500 may generate a plurality of first gate clock signals and second gate clock signals having different phases from each other.

The scan driving circuit 300 receives the first start control signal FLMp and the second start control signal FLMn from the driving controller 200, and receives the first gate clock signal CKVP and the second gate clock signal CKVN from the clock and voltage generation circuit 500. The scan driving circuit 300 generates a plurality of scan signals, and sequentially outputs the plurality of scan signals to the first type scan lines SPL1 to SPLn and the second type scan lines SNL1 to SNLn (to be described later in more detail). In addition, the scan driving circuit 300 generates a plurality of emission control signals in response to the first start control signal FLMp and the second start control signal FLMn, and outputs the plurality of emission control signals to a plurality of control lines EL1 to ELn.

In an exemplary embodiment of the inventive concept, the scan driving circuit 300 may output scan signals to be provided to the first type scan lines SPL1 to SPLn in response to the first start control signal FLMp and the first gate clock signal CKVP, and output scan signals to be provided to the second type scan lines SNL1 to SNLn in response to the second start control signal FLMn and the second gate clock signal CKVN.

In FIG. 1, the plurality of scan signals and the plurality of emission control signals are output from one scan driving circuit 300, but the embodiment of the inventive concept is not limited thereto. In another embodiment of the inventive concept, a plurality of scan driving circuits may divide to output a plurality of scan signals, and divide to output a plurality of emission control signals. In addition, in another embodiment of the inventive concept, a driving circuit configured to generate to output the plurality of scan signals, and a driving circuit configured to generate to output the plurality of emission control signals may be separated.

The data driving circuit 400 receives a data control signal DCS and an image data signal DATA from the driving controller 200. The data driving circuit 400 converts the image data signal DATA into data signals, and outputs the data signals to a plurality of data lines DL1 to DLm to be described later. The data signals are analog voltages corresponding to gray scale values of the image data signal DATA.

The display panel 100 includes the first type scan lines SPL1 to SPLn, the second type scan lines SNL1 to SNLn, the control lines EL1 to ELn, the data lines DL1 to DLm, and a plurality of pixels PX. The first type scan lines SPL1 to SPLn and the second type scan lines SNL1 to SNLn are extended in a first direction DR1, and separately arrayed in a second direction DR2. The data lines DL1 to DLm are extended in the second direction DR2 and separately arrayed in the first direction DR1.

Each of the plurality of control lines EL1 to ELn may be arrayed parallel to a corresponding scan line among the second type scan lines SNL1 to SNLn.

Each of the plurality of pixels PX is connected to a corresponding first type scan line among the first type scan lines SPL1 to SPLn, a corresponding second type scan line among the second type scan lines SNL1 to SNLn, a corresponding control line among the control lines EL1 to ELn, and a corresponding data line among the data lines DL1 to DLm.

Each of the plurality of pixels PX receives the first driving voltage ELVDD and the second driving voltage ELVSS having a lower level than the first driving voltage ELVDD. Each of the plurality of pixels PX is connected to a first driving voltage line VL1 to which the first driving voltage ELVDD is applied. Each of the pixels PX is connected to an initialization voltage line RL configured to receive the initialization voltage Vint.

Each of the plurality of pixels PX may be electrically connected to 4 scan lines. As shown in FIG. 1, pixels PX in a second pixel row may be connected to the scan lines SNL1, SPL2, SNL2, and SPL3.

Each of the plurality of pixels PX includes an organic light emitting diode (not shown) and a pixel circuit unit (not shown) configured to control emission of the organic light emitting diode. The pixel circuit unit may include a plurality of transistors and a capacitor. At least any one of the scan driving circuit 300 and the data driving circuit 400 may include transistors provided through the same process as that of the pixel circuit unit.

The first type scan lines SPL1-SPLn, the second type scan lines SNL1-SNLn, the control lines EL1-ELn, the data lines DL1-DLm, the first driving voltage line VL1, the initialization voltage line RL, the pixels PX, the scan driving circuit 300, and the data driving circuit 400 may be provided on a base substrate (not shown) through multiple times of a photolithography process. A plurality of insulation layers may be provided on the base substrate (not shown) through multiple times of a deposition process or a coating process. Each of the plurality of insulation layers may be a thin film configured to entirely cover the display panel 100, or include at least one insulation pattern superimposed only on a specific component of the display panel 100. The plurality of insulation layers may include an organic layer and/or an inorganic layer. Besides, an encapsulation layer (not shown) configured to protect the pixels PX may be further provided on the base substrate.

The display panel 100 receives the first driving voltage ELVDD and the second driving voltage ELVSS. The first driving voltage ELVDD may be provided to the plurality of pixels PX through the first driving voltage line VL1. The second driving voltage ELVSS may be provided to the plurality of pixels PX through electrodes (not shown) or a power line (not shown) provided in the display panel 100.

The display panel 100 receives the initialization voltage Vint. The initialization voltage Vint may be provided to the plurality of pixels PX through an initialization voltage line RL.

The display panel 100 is divided into a display area DPA and a non-display area NDA. The plurality of pixels PX are arrayed in the display region DPA. In the present embodiment, the scan driving circuit 300 is arranged in the non-display area NDA that is one side of the display area DPA.

Figure 2:
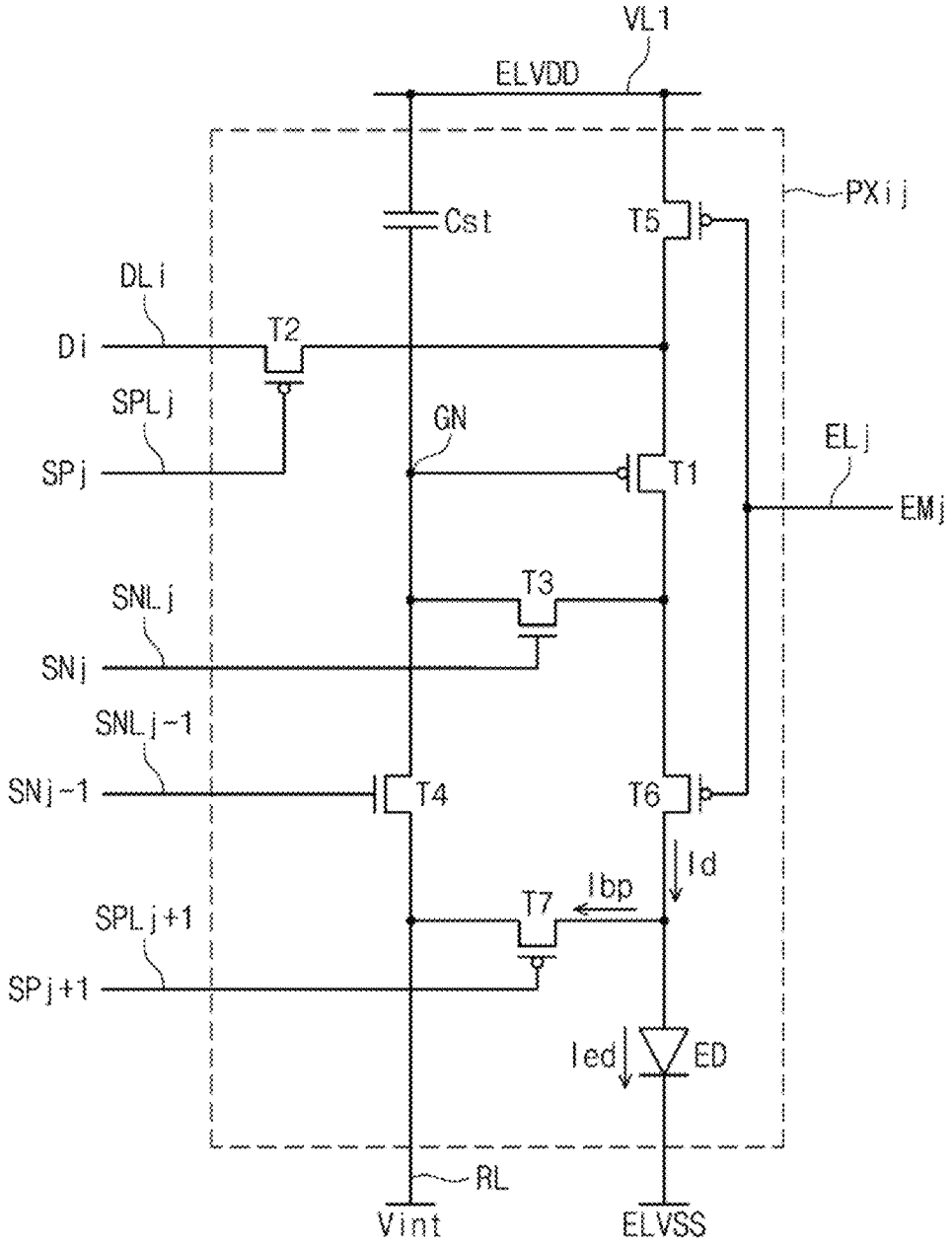
FIG. 2 is an equivalent circuit diagram of a pixel according to an embodiment of the inventive concept.
Figure 3:
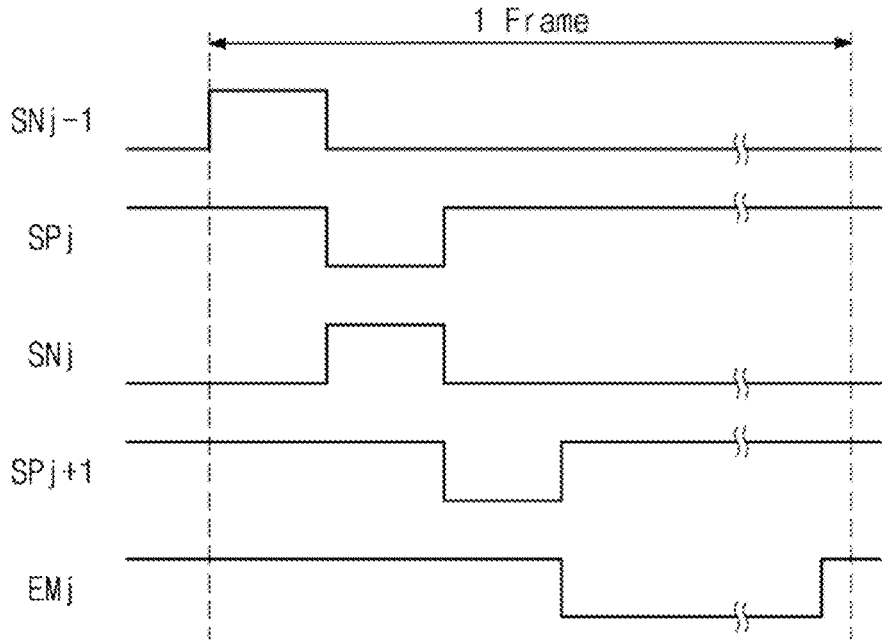
FIG. 3 is a timing diagram for explaining an operation of the pixel of the organic light emitting display device of FIG. 2.

FIG. 2 is an equivalent circuit diagram of the pixel according to an embodiment of the inventive concept. FIG. 3 is a timing diagram for explaining an operation of the pixel of the organic light emitting display device of FIG. 2.

FIG. 2 illustrates an equivalent circuit diagram of a pixel PXij connected to an ith data line DLi among the plurality of data lines DL1 to DLm shown in FIG. 1, a jth first type scan line SPLj and a (j+1)th first type scan line SPLj+1 among the plurality of first type scan lines SPL1 to SPLn, a jth second type scan line SNLj and a (j−1)th second type scan line SNLj−1 among the plurality of second type scan lines SNL1 to SNLn, and a jth control line ELj among the plurality of control lines EL1 to ELn. Each of the plurality of pixels PX shown in FIG. 1 may have the same circuit configuration as the equivalent circuit diagram of the pixel PXij shown in FIG. 2. In the present embodiment, the circuit unit of the pixel PXij includes first to seventh transistors T1 to T7 and one capacitor Cst. In addition, each of the first, second, fifth, sixth and seventh transistors T1, T2, T5, T6 and T7 is a P-type transistor having an LTPS semiconductor layer, and each of the third and fourth transistors T3 and T4 is an N-type transistor having oxide semiconductor as a semiconductor layer. However, the embodiment of the inventive concept is not limited thereto, and at least one of the first to seventh transistors T1 to T7 may be an N-type transistor and the rest may be P-type transistors. In addition, the circuit configuration of the pixel according to an embodiment of the inventive concept is not limited to FIG. 2. The pixel circuit unit shown in FIG. 2 is only an example, and the configuration of the pixel circuit unit may be modified to be practiced.

In reference to FIG. 2, the pixel PXij of the display device according to an embodiment includes the first to seventh transistors T1, T2, T3, T4, T5, T6 and T7, the capacitor Cst, and at least one light emitting diode ED. In the present embodiment, an example in which one pixel PXij includes one light emitting diode ED will be described.

For convenience of explanation, the jth first type scan line SPLj, the jth second type scan line SNLj, the (j−1)th second type scan line SNLj−1, and the (j+1)th first type scan line SPLj+1 are respectively referred to as a first scan line SPLj, a second scan line SNLj, a third scan line SNLj−1, and a fourth scan line SPLj+1.

The first to fourth scan lines SPLj, SNLj, SNLj−1, and SPLj+1 may respectively transfer scan signals SPj, SNj, SNj−1, and SPj+1. The first scan signals SPj and SPj+1 may turn on or off the second and seventh transistors T2 and T7 that are the P-type transistors. The second scan signals SNj and SNj−1 may turn the third and fourth transistors T3 and T4 (i.e., the N-type transistors) on or off.

The control line ELj may transfer an emission control signal EMj capable of controlling emission of the light emitting diode ED included in the pixel PXij. The emission control signal EMj transferred by the control line ELj may have a different waveform from the scan signals SPj, SNj, SNj−1, and SPj+1 respectively transferred by the first to fourth scan lines SPLj, SNLj, SNLj−1, and SPLj+1. The data line DLi may transfer a data signal Di, and the first driving voltage line VL1 may transfer the first driving voltage ELVDD. The data signal Di may have a different voltage level according to an image signal to be input to the display device, and the first driving voltage ELVDD may have a substantially constant level.

The first transistor T1 includes a first electrode connected to the first driving voltage line VL1 via the fifth transistor T5, a second electrode electrically connected to the anode of the light emitting diode ED via the sixth transistor T6, and a gate electrode connected to one end of the capacitor Cst. The first transistor T1 receives the data signal Di transferred by the data line DLi according to a switching operation of the second transistor T2, and provides a driving current Id to the light emitting diode ED. The first transistor T1 may be referred to as a driving transistor.

The second transistor 12 includes a first electrode connected to the data line DLi, a second electrode connected to the first electrode of the first transistor T1, and a gate electrode connected to the first scan line SPLj. The second transistor T2 may be turned on according to the scan signal SPj received through the first scan line SPLj, and may transfer the data signal Di received from the data line DLi to a source electrode of the first transistor T1.

The third transistor T3 includes a first electrode connected to the gate electrode of the first transistor T1, a second electrode connected to the second electrode of the first transistor T1, and a gate electrode connected to the second scan line SNLj. The third transistor T3 may be turned on according to the scan signal SNj received through the second scan line SNLj, and connect the gate electrode and the second electrode of the first transistor T1 with each other to diode-connect the first transistor T1.

The fourth transistor T4 includes a first electrode connected to the gate electrode of the first transistor T1, a second electrode connected to the initialization voltage line RL through which the initialization voltage Vint is transferred, and a gate electrode connected to a third scan line SNLj−1. The fourth transistor T4 may be turned on according to the scan signal SNLj−1 received through the third scan line SNLj−1, and transfers the initialization voltage Vint to the gate electrode of the first transistor T1 to perform an initialization operation for initializing a voltage of the gate electrode of the first transistor T1.

The fifth transistor T5 includes a first electrode connected to the first driving voltage line VL1, a second electrode connected to the first electrode of the first transistor T1, and a gate electrode connected to the jth control line ELj.

The sixth transistor T6 includes a first electrode connected to the second electrode of the first transistor T1, a second electrode connected to the anode of the light emitting diode ED, and a gate electrode connected to the jth control line ELj.

The fifth transistor T5 and the sixth transistor T6 are substantially simultaneously turned on according to the emission control signal EMj received through the jth control line ELj, and through this process, the first driving voltage ELVDD may be compensated through the diode-connected first transistor T1 to be transferred to the light emitting diode ED.

The seventh transistor T7 includes a first electrode connected to the second electrode of the fourth transistor T4, a second electrode connected to the second electrode of the sixth transistor T6, and a gate electrode connected to the fourth scan line SPLj+1.

As described above, the one end of the capacitor Cst is connected to the gate electrode of the first transistor T1, and the other end is connected to the first driving voltage line VL1. The cathode of the light emitting diode ED may be connected to a terminal through which the second driving voltage ELVSS is transferred. The structure of the pixel PXij according to the embodiment is not limited to the structure shown in FIG. 2; the number of transistors and the number of capacitors included in one pixel, and the connection relationship thereof, are modifiable in various ways.

With reference to FIG. 3 together with the above-described FIG. 2, an operation of the display device according to an embodiment will be described.

In reference to FIGS. 2 and 3, a scan signal SNj−1 of a high level is supplied through the third scan line SNj−1 during an initialization period within one frame. In response to the scan signal SNj−1 of the high level, the fourth transistor T4 is turned on, and the initialization voltage Vint is transferred through the fourth transistor T4 to the gate electrode of the first transistor T1, and thus the first transistor T1 is initialized.

Then, when the scan signal SPj of a low level is supplied through the first scan line SPLj during a data programming and compensation period, the second transistor T2 is turned on, and at substantially the same time, when the scan signal SNj of a high level is supplied through the second scan line SNLj, the third transistor T3 is turned on. Here, the first transistor T1 is diode-connected by the turned-on third transistor T3 and biased in a forward direction. Then, a compensation voltage Di−Vth, which is reduced by a threshold voltage Vth of the first transistor T1 from the data signal Di supplied from the data line DLi, is applied to the gate electrode of the first transistor T1. In other words, the gate voltage applied to the gate electrode of the first transistor T1 may be the compensation voltage Di−Vth.

The first driving voltage ELVDD and the compensation voltage Di−Vth may be applied to both ends of the capacitor Cst, and charges corresponding to the voltage difference between the both ends may be stored in the capacitor Cst.

During a bypass period, the seventh transistor T7 receives a scan signal SLj+1 of a low level through the fourth scan line SPLj+1 to be turned on. A part of the driving current Id may be a bypass current Ibp to flow out through the seventh transistor T7.

Even when a minimum current of the first transistor T1, which displays a black image, flows as the driving current, the black image may not be properly displayed when the light emitting diode ED emits light. Accordingly, the seventh transistor T7 of the organic light emitting display device according to an embodiment of the inventive concept inns disperse, as the bypass current Ibp, a part of the minimum current of the first transistor T1 to other current paths besides a current path of the light emitting diode ED. The minimum current of the first transistor T1 means a current under a condition that a gate-source voltage Vgs of the first transistor T1 is smaller than the threshold voltage Vth to turn off the first transistor T1. Under the condition of turning off the first transistor T1, the minimum driving current (for example, current of 10 pA or smaller) is transferred to the light emitting diode ED and a black luminance image is displayed.

When the minimum driving current for displaying the black image flows, an influence of the bypass current Ibp is large. However, when a large driving current for displaying an image such as a typical image or a white image flows, there is little influence from the bypass current Ibp. Accordingly, when the driving current for displaying the black image flows, an emission current Ied of the light emitting diode ED, which is reduced by a current amount of the bypass current Ibp flowing out through the seventh transistor T7 from the driving current Id, has a minimum current amount through which the black image may be reliably displayed. Accordingly, a contrast ratio may be improved by implementing an accurate black luminance image using the seventh transistor T7. In the present embodiment, the bypass signal is a scan signal SLj+1, but is not limited thereto.

Then, during an emission period, the emission control signal EMj supplied from the jth control line ELj is changed from a high level to a low level. During the emission period, the fifth transistor T5 and the sixth transistor T6 are turned on by the emission control signal EMj. Then, the driving current Id is generated according to the voltage difference between the gate voltage of the gate electrode of the first transistor T1 and the first driving voltage ELVDD, and the driving current Id is supplied to the light emitting diode ED through the sixth transistor T6 and the emission current led flows to the light emitting diode ED. During the emission period, the gate-source voltage Vgs of the first transistor T1 is maintained as "ELVDD−(Di−Vth)" by the capacitor Cst. According to the current-voltage relationship of the first transistor T1, the driving current Id may be proportional to "$(ELVDD-Di)^2$" that is square of a value obtained by subtracting the threshold voltage Vth from the gate-source voltage Vgs of the first transistor T1(Vgs−Vth=ELVDD−(Di−Vth)−Vth). Accordingly, the driving current Id may be determined regardless of the threshold voltage fifth of the first transistor T1.

Figure 4:
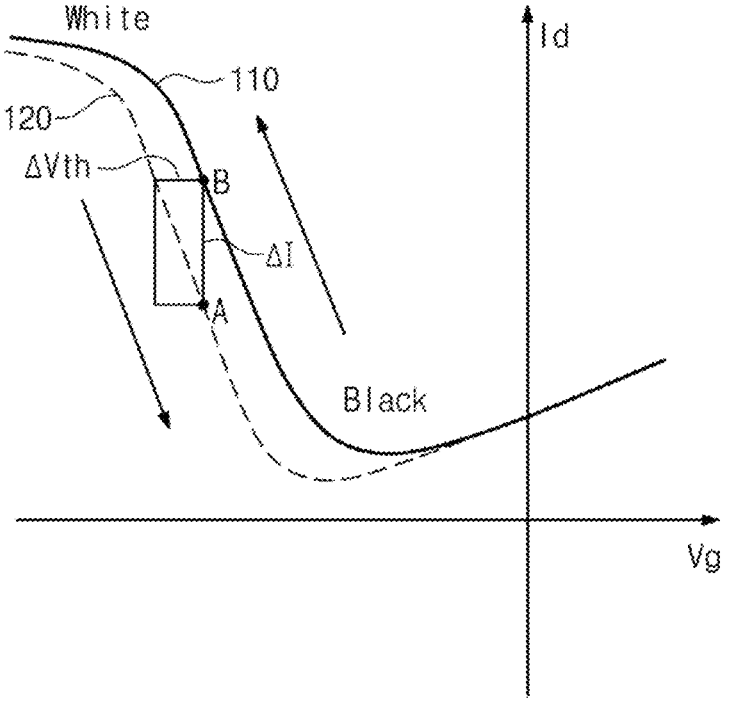
FIG. 4 illustrates hysteresis characteristics of a transistor in the pixel of the display device according to embodiments of the inventive concept.

FIG. 4 illustrates hysteresis characteristics of a transistor in a pixel of the display device according to embodiments of the inventive concept.

In reference to FIG. 4, when the light emitting diode ED in the pixel PXij shown in FIG. 2 continuously emits light, the first transistor T1 of the pixel PXij may have a first voltage-current characteristic 120. When the pixel PXij does not continuously emit light, the first transistor T1 may have a second voltage-current characteristic 110. That is, the voltage current characteristics of a pixel may depend on the voltage applied to the pixel in a previous frame. This may cause and afterimage effect in which the luminance of a pixel is impacted by a previous image. Embodiments of the present disclosure describe systems and methods for reducing the afterimage effect.

The voltage-current characteristic of the pixel PXij varies according to a data signal Di transferred through the data line DLi. For example, when the luminance of a first pixel, which includes the first transistor T1 having a first voltage-current characteristic 120, among a plurality of pixels PX arrayed in the display panel 100 (see FIG. 1), is different from that of a second pixel including the first transistor T1 that has a second voltage-current characteristic 110, a shadow effect may be generated. In addition, when a first region, in which a plurality of first pixels having the first voltage-current characteristic 120 are included, is adjacent to a second region in which a plurality of second pixels having the second voltage-current characteristic 110 are included, and all the plurality of first pixels and the plurality of second pixels are changed to an emission state, an afterimage may be generated at an instant when the boundary between the first region and the second region is visually recognized.

When the brightness of the pixel PXij is changed from a high gray scale (for example, a white gray scale) to an intermediate gray scale, the absolute value |Vg| of the gate voltage Vg of the first transistor T1 is changed from a large value to a small value. Since the gate voltage |Vg| having a relatively high absolute value in the high gray scale is first input to the gate electrode of the driving transistor T1, the driving current Id of the driving transistor T1 may be identical to the current at point "A", when the gate voltage Vg corresponding to the intermediate gray scale is applied to the gate electrode of the driving transistor T1 in a state where the absolute value |Vth| of the threshold voltage Vth of the driving transistor is increased.

When the brightness of the pixel PXij is changed from a low gray scale (for example, black gray scale) to an intermediate gray scale, the absolute value |Vg| of the gate voltage Vg of the first transistor T1 is changed from a small value to a large value. Here, since the gate voltage Vg having a relatively small absolute value in the low gray scale is first input to the gate electrode of the first transistor T1, the driving current Id of the first transistor may be identical to the current at point "B" when the gate voltage Vg corresponding to the intermediate gray scale is applied to the gate electrode of the first transistor T1 in a state where the absolute value |Vth| of the threshold voltage Vth of the first transistor T1 is reduced by ΔVth.

Due to the hysteresis characteristics of the first transistor T1, even when an identical gate voltage Vg is applied to the gate electrode of the first transistor T1 in order to represent the brightness of the intermediate gray scale, different currents flow to the light emitting diode ED according to a gray scale in a previous frame. In other words, when the identical gate voltage Vg is applied to two gate electrodes of two pixels in order to display the brightness of the intermediate gray scale, the current difference ΔI occurs between a pixel to which the gate voltage Vg of a low gray scale was applied in a previous frame and a pixel to which a gate voltage Vg of a high gray scale was applied in a previous frame. The current difference ΔI may cause an afterimage to appear on the display.

Figure 5:
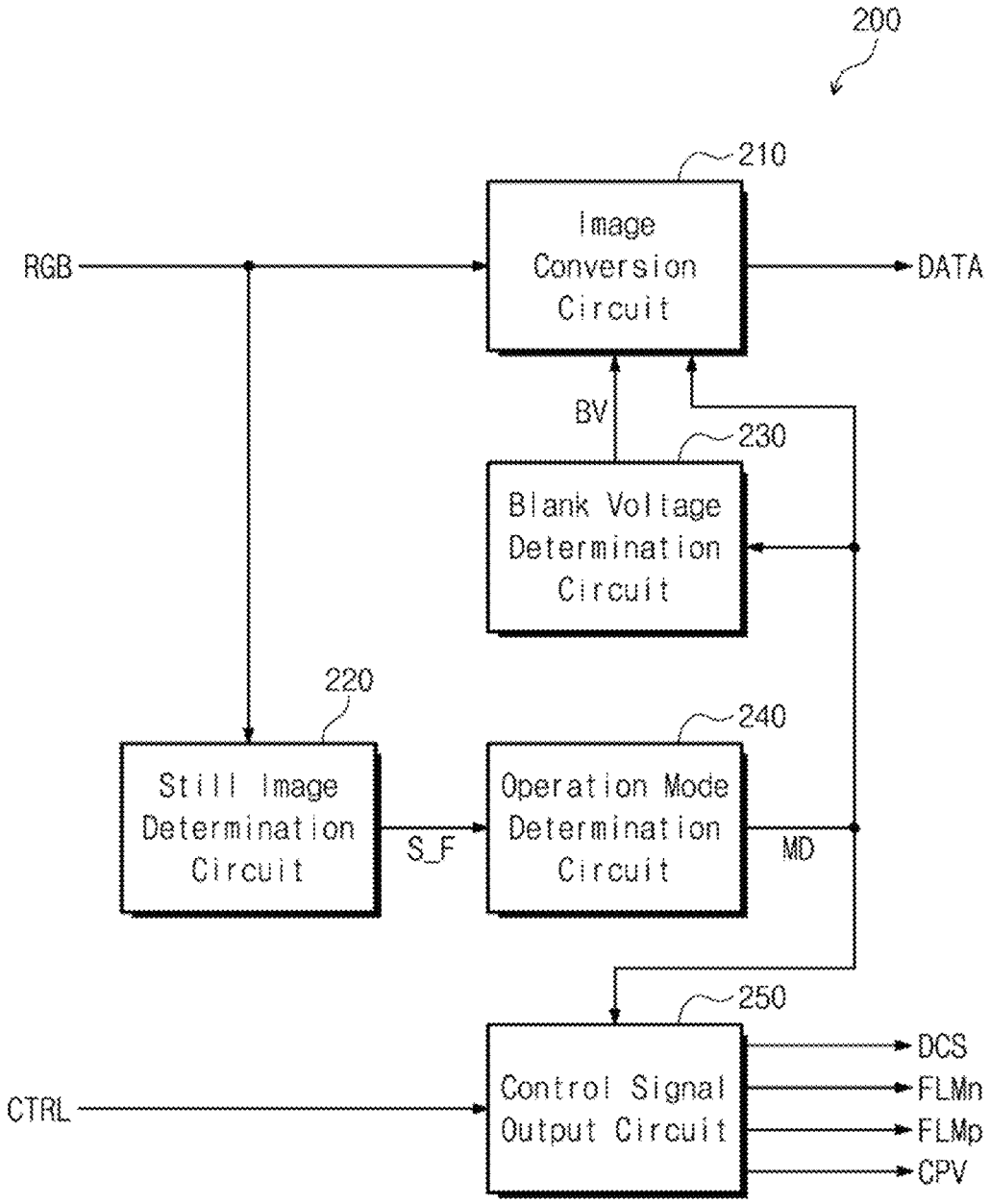
FIG. 5 is a block diagram of a driving controller according to n exemplary embodiment of the inventive concept.

FIG. 5 is a block diagram of a driving controller according to an exemplary embodiment of the inventive concept.

In reference to FIG. 5, the driving controller 200 includes an image conversion circuit 210, a still image determination circuit 220, a blank voltage determination circuit 230, an operation mode determination circuit 240, and a control signal output circuit 250.

The image conversion circuit 210 receives an image signal RGB, and outputs an image data signal DATA that is corrected to be suitable for the characteristics of the display panel 100 (shown in FIG. 1). For example, the image conversion circuit 210 may perform Adaptive Color Correction (ACC) of the image signal RGB or a Dynamic Capacitance Compensation (DCC).

The externally provided image signal RGB may include a red image signal, a green image signal, and a blue image signal. In an exemplary embodiment of the inventive concept, when the pixels PX provided in the display panel 100 (shown in FIG. 1) include red pixels, green pixels, blue pixels and white pixels, the image conversion circuit 210 may convert the image signal RGB into an image data signal DATA including a red data signal, a green data signal, a blue data signal, and a white data signal respectively corresponding to the red pixels, the green pixels, the blue pixels, and the white pixels provided in the display panel 100.

In another embodiment, when the pixels PX provided in the display panel 100 (shown in FIG. 1) include red pixels, first green pixels, blue pixels and second green pixels, the image conversion circuit 210 may convert the image signal RGB into an image data signal DATA including a red data signal, a first green data signal, a blue data signal, and a second green data signal respectively corresponding to the red pixels, the first green pixels, the blue pixels, and the second green pixels provided in the display panel 100.

The still image determination circuit 220 may determine whether the image signal RGB of one frame corresponds to a still image or a moving image. For example, the still image determination circuit 220 may determine that the image signal RGB of a current frame is a still image when the image signal RGB of a previous frame is identical or substantially similar to the image signal RGB of the current frame.

In an exemplary embodiment of the inventive concept, the still image determination circuit 220 may extract a representative value for the image signal RGB of one frame using a Linear Feedback Shift Register (LFSR), and compare a representative value of a previous frame and the representative value of the current frame to determine whether the image signal RGB of the current frame is a still image. In some embodiments, identifying a still image using the LFSR does not require a memory, and thus a manufacturing cost of the still image determination circuit 220 may be lowered.

The still image determination circuit 220 outputs a still image flag signal S_F indicating an active level (for example, a high level), when the image signal RGB of the current frame is determined to be a still image (for example, when the image signal RGB of the previous frame is identical to the image signal RGB of the current frame). The still image determination circuit 220 outputs a still image flag signal S_F indicating an inactive level (for example, a low level), when the image signal RGB of the current frame is not determined to be a still image (for example, when the image signal of the previous frame is not identical to the image signal RGB of the current frame).

By determining whether the image signal RGB is a still image, the still image determination circuit 220 that enables the driving controller 200 may control the display panel 100 in a manner that reduces power usage and improves the quality of the display. For example, the driving controller 200 may adjust the operating frequency and the gray scale value for blank data.

The operation mode determination circuit 240 outputs a (operation) mode signal MD in response to the still image flag signal S_F. The mode signal MD may indicate a normal frequency mode NFM, a low frequency mode LFM, or an image transition mode TM. The mode signal MD may include a plurality of bits representing a plurality of operation modes.

The operation mode determination circuit 240 outputs a mode signal MD indicating the normal frequency mode NFM when the still image flag signal S_F indicates the inactive level (for example, a low level) (in other words, the image signal RGB is not a still image). The mode signal MD is provided to the image conversion circuit 210, the blank voltage determination circuit 230 and the control signal output circuit 250.

The operation mode determination circuit 240 outputs a mode signal MD indicating the low frequency mode LFM, when the still image flag signal S_F indicates an active level (e.g., a high level, in other words, the image signal RGB is a still image). A driving frequency (for example, a first frequency) in the normal frequency mode NFM is not lower than that (for example, a second frequency) in low frequency mode LFM. By using a lower frequency when a still image is detected, power usage may be reduced without negatively impacting the viewing experience of a user of the display panel 100.

The operation mode determination circuit 240 outputs a mode signal MD indicating the image transition mode TM, when the still image flag signal S_F is changed from the active level to the inactive level. The driving frequency of the image transition mode TM may be higher than that of the low frequency mode LFM. For example, the driving frequency of the image transition mode TM may be the same as that of the normal frequency mode NFM (i.e., the first frequency). As an example, the first frequency may be 60 Hz, 120 Hz, or 240 Hz, and the second frequency may be 1 Hz, 15 Hz, or 30 Hz.

The operation mode determination circuit 240 outputs the mode signal MD indicating the image transition mode TM for a prescribed time (for example, 30 frames), after the still image flag signal S_F is changed from the active level to the inactive level, and outputs the mode signal MD indicating the low frequency mode LFM, when the still image flag signal S_F indicates the active level after passage of the prescribed time. Using an image transition mode TM during the transition from the normal frequency mode NFM to the low frequency mode LFM may enable the driving controller 200 to reduce the potential for an afterimage.

The blank voltage determination circuit 230 outputs a blank voltage signal BV in response to the mode signal MD. The blank voltage determination circuit 230 provides, to the image conversion circuit 210, the blank voltage signal BV corresponding to a first gray scale when the mode signal MD indicates the low frequency mode LFM (in other words, the image signal RGB is a still image). For example, the first gray scale may be the black gray scale.

The blank voltage determination circuit 230 outputs a blank voltage signal BV corresponding to a second gray scale when the mode signal MD indicates the image transition mode TM. For example, the second gray scale may be a white gray scale. The blank voltage determination circuit 230 outputs the blank voltage signal BV corresponding to the first gray scale again when the mode signal MD is changed from the image transition mode TM to the low frequency mode LFM. Hereinafter, it is assumed that the first gray scale is the black gray scale, and the second gray scale is the white gray scale, but the inventive concept is not limited thereto.

In response to a control signal CTRL provided externally and the mode signal MD from the operation mode determination circuit 240, the control signal output circuit 250 outputs the data control signal DCS, the first start control signal FLMp, the second start control signal FLMn, and the gate pulse signal CPV.

By determining the characteristics of incoming RGB data, embodiments of the inventive concept may allow for lower power usage by switching display modes. The image conversion circuit 210 and the control signal output circuit 250 may drive the display panel 100 in these different modes by outputting signals that determine the refresh rate of the display, and the type of blank voltage to be applied, where appropriate. Furthermore, in cases where the mode signal MD indicates the image transition mode TM, the display may automatically revert to a low frequency mode LFM after a predetermined amount of time allotted for the changing image, which may further reduce power usage.

Figure 6A:
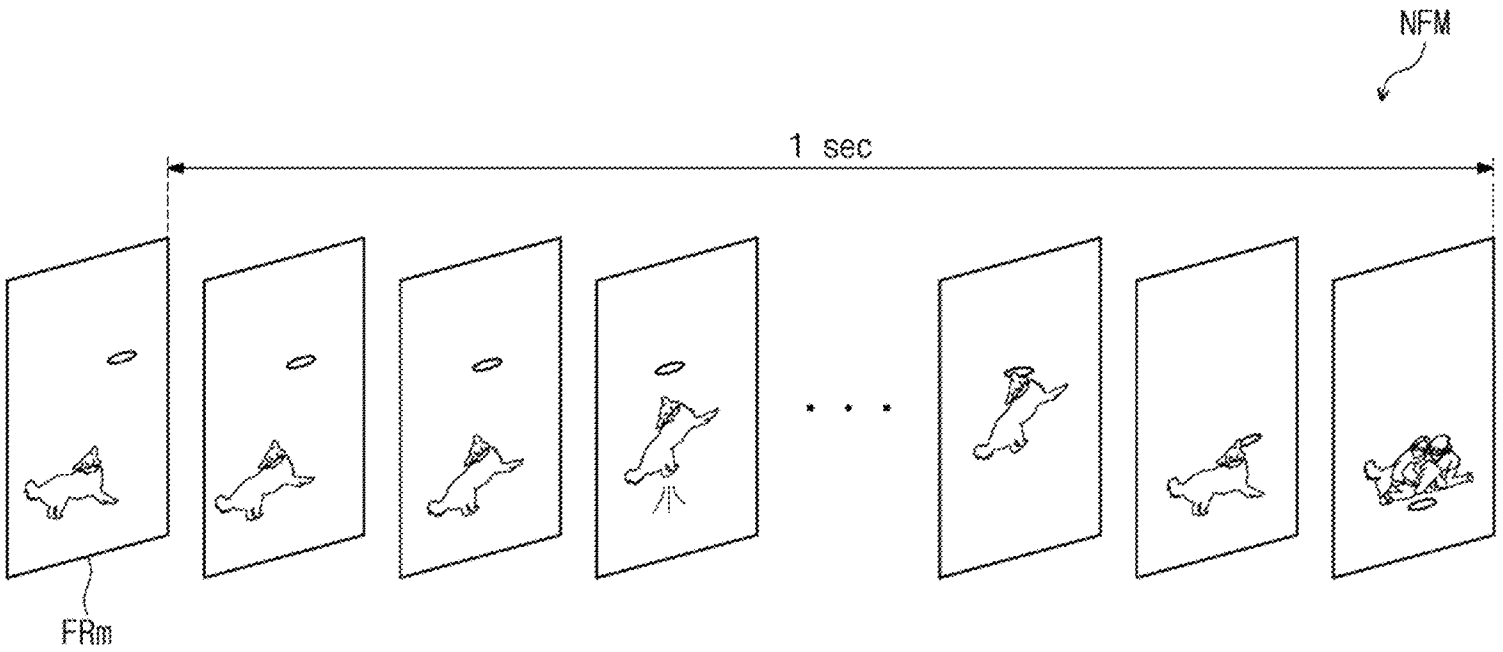
FIG. 6A illustrates an operation of the display device in a normal frequency mode.
Figure 6B:
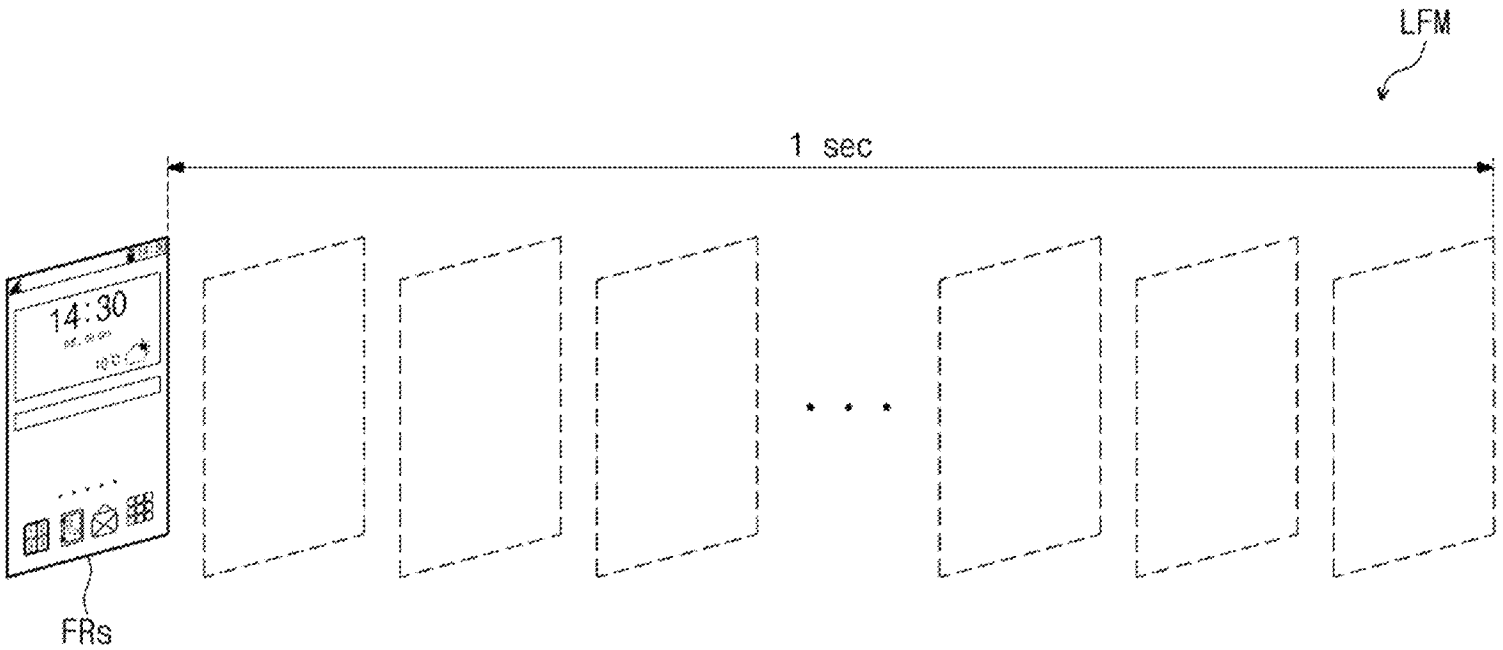
FIG. 6B illustrates an operation of the display device in a low frequency mode.

FIG. 6A illustrates an operation of the display device in a normal frequency mode. FIG. 6B illustrates an operation of the display device in a low frequency mode.

In the normal frequency mode NFM, the driving frequency of the display device 10 shown in FIG. 1 is the first frequency. As an example, the first frequency may be any one among 60 Hz, 120 Hz, and 240 Hz. When the externally provided image signal RGB is not a still image, the display device 10 may operate in the normal frequency mode NFM. For example, when the driving frequency of the display device 10 is 60 Hz in the normal frequency mode NFM, an image of 60 frames FRm may be displayed on the display device 10 for one second. When a moving image is displayed on the display device 10 in the normal frequency mode NFM, a user may watch the natural moving image without seams in image transition.

In the low frequency mode LFM, the driving frequency of the display device 10 shown in FIG. 1 is the second frequency (i.e., smaller than the first frequency). As an example, the second frequency may be any one among 1 Hz, 15 Hz, and 30 Hz.

When the externally provided image signal RGB is a still image in which the prescribed number of frames are identical (i.e., where the current frame is the same or similar to one or more previous frames), the display device 10 operates in the low frequency mode LFM instead of repeatedly outputting the identical image. For example, when the driving frequency of the display device 10 is 1 Hz in the low frequency mode LFM, an image of 1 frame LRs may be displayed on the display device 10 for one second. For the remaining 59 frames within one second, the data driving circuit 400 (shown in FIG. 1) and the scan driving circuit 300 (shown in FIG. 1) may not operate and thus the power consumption of the display device 10 may be reduced.

Figure 7:
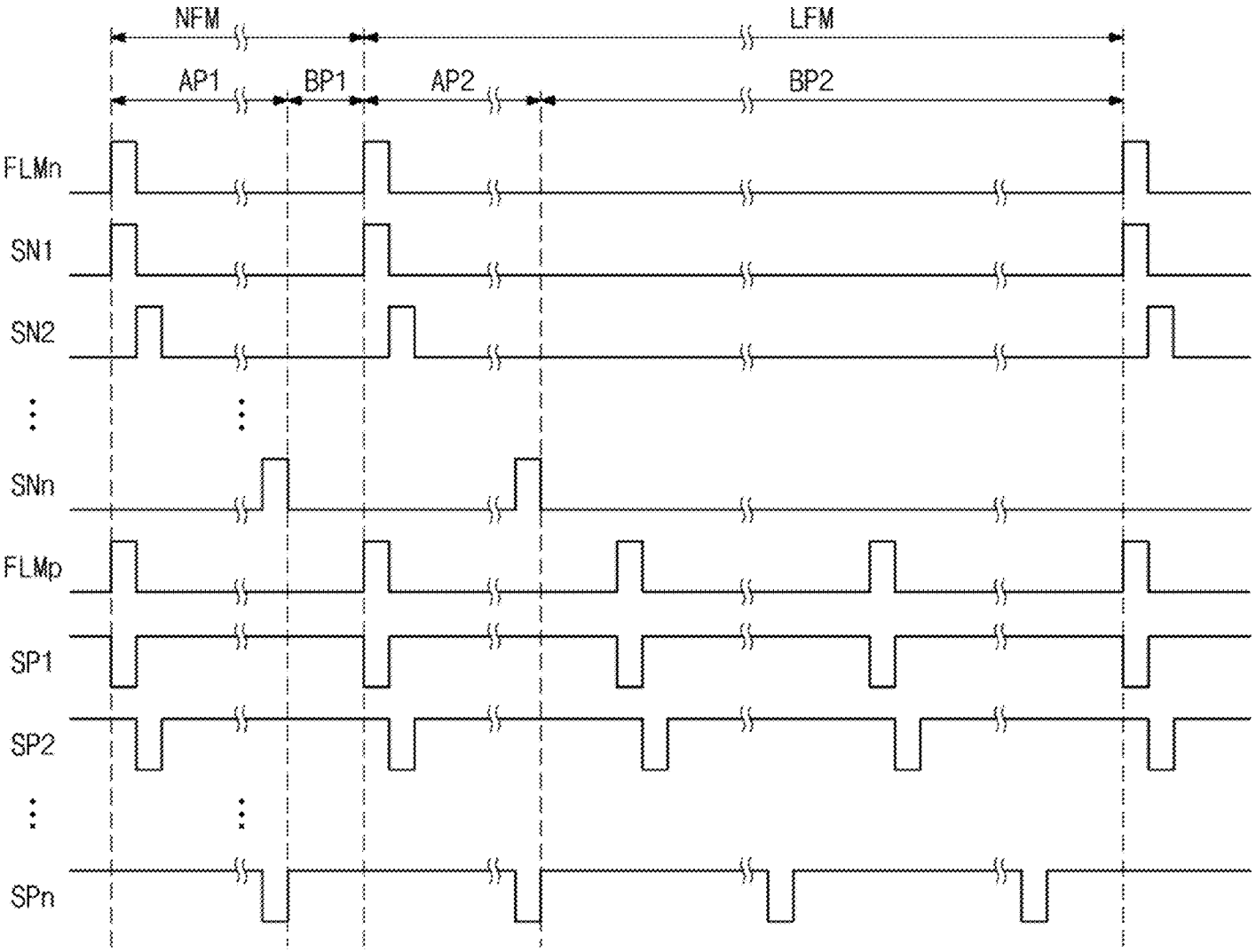
FIG. 7 illustrates scan signals corresponding to a driving frequency determined by an operation mode determining circuit according to embodiments of the inventive concept.

FIG. 7 illustrates scan signals corresponding to the driving frequency determined by the operation mode determination circuit according to embodiments of the inventive concept.

In reference to FIGS. 1, 5 and 7, the control signal output circuit 250 outputs the first start control signal FLMp and the second start control signal FLMn in response to the externally provided control signal CTRL and the mode signal MD from the operation mode determination circuit 240.

The scan driving circuit 300 outputs first scan signals SP1 to SPn to the first type scan lines SPL1 to SPLn, and second scan signals SN1 to SNn to the second type scan lines SNL1 to SNLn in response to the first start control signal FLMp, the second start control signal FLMn, the first gate clock signal CKVP and the second gate clock signal CKVN.

During the normal frequency mode NFM, the control signal output circuit 250 may output the first start control signal FLMp and the second start control signal FLMn of the first frequency (for example, 60 Hz). During the normal frequency mode NFM, a frequency of the first start control signal FLMp may be the same as that of the second start control signal FLMn. During one frame of the normal frequency mode NFM, the first scan signals SP1 to SPn are sequentially activated at a low level, and the second scan signals SN1 to SNn are sequentially activated at a high level.

During the low frequency mode LFM, the control signal output circuit 250 may output the first start control signal FLMp at the first frequency (for example, 60 Hz) and the second start control signal FLMn at a frequency of 1 Hz. During the low frequency mode LFM, the scan driving circuit 300 outputs the first scan signals SP1 to SPn at the first frequency (e.g. 60 Hz) in synchronization with the first start control signal FLMp at the first frequency (e.g. 60 Hz), and outputs the second scan signals SN1 to SNn at the second frequency (e.g. 1 Hz) in synchronization with the second start control signal FLMn at the second frequency (e.g. 1 Hz).

One frame includes an active period (e.g., active periods AP1 and AP2) in which the second scan signals SN1 to SNn are sequentially activated (i.e., set to a high level), and a blank period (e.g., blank periods BP1 and BP2) in which the second scan signals SN1 to SNn are all maintained at a low level.

For the second scan signals SN1 to SNn, the active period AP1 in the normal frequency mode NFM is identical to the active period AP2 in the low frequency mode LFM, but the blank period BP1 in the normal frequency mode NFM is not longer than the blank period BP2 in the low frequency mode LFM.

For example, when the driving frequency corresponds to 1 Hz, 15 Hz, or 30 Hz, the lengths of the active periods in one frame are identical, and the lengths of the blank periods of the second scan signals SN1 to SNn may be different in the low frequency mode LFM. For example, as the driving frequency becomes lowered, the length of the blank period becomes longer.

In an exemplary embodiment of the inventive concept, during the low frequency mode LFM, the frequencies of the second scan signals ST1 to SNn to be provided to the second type scan lines SNL1 to SNLn are lowered, but the frequencies of the first scan signals SP1 to SPn to be provided to the first type scan lines SPL1 to SPLn and the emission control signals EM1 to EMn to be provided to the control lines EL1 to ELn are maintained at a normal level (e.g. 60 Hz). However, an embodiment of the inventive concept is not limited thereto, and may be modified in various ways. In another embodiment, the frequencies of the first scan signals SP1 to SPn to be provided to the first type scan lines SPL1 to SPLn and the emission control signals EM1 to EMn to be provided to the control lines EL1 to ELn may be changed to low frequencies identically to the second scan signals SN1 to SNn to be provided to the second type scan lines SNL1 to SNLn. In this alternative embodiment, the power usage of the display device 10 may be lowered further.

In reference to FIG. 2 again, when the first to seventh transistors T1 to T7 are all driven with signals in low driving frequencies in the low frequency mode LFM, a flicker phenomenon may occur such that a current amount flowing through the light emitting diode ED is changed by leakage currents through the first, second, fifth, sixth, and seventh transistors T1, T2, T5, T6 and T7, which may be PMOS transistors.

According to an embodiment of the inventive concept, in the low frequency mode LFM, the first, second, fifth, sixth and seventh transistors T1, T2, T5, T6, and T7 are driven at 60 Hz, and the third and fourth transistor T3 and T4 are driven at 1 Hz.

In some cases, when an image transition occurs in which an image signal RGB of a current frame is different from that of a previous frame, the display device 10 may not directly change from the low frequency mode LFM to the normal frequency mode NFM, but may operate in an image transition mode TM. For example, when only the number of a clock in the frame FRs shown in FIG. 6B is changed, it may be more suitable that the display device 10 operates in an image transition mode TM instead of the normal frequency mode NFM.

Figure 8:
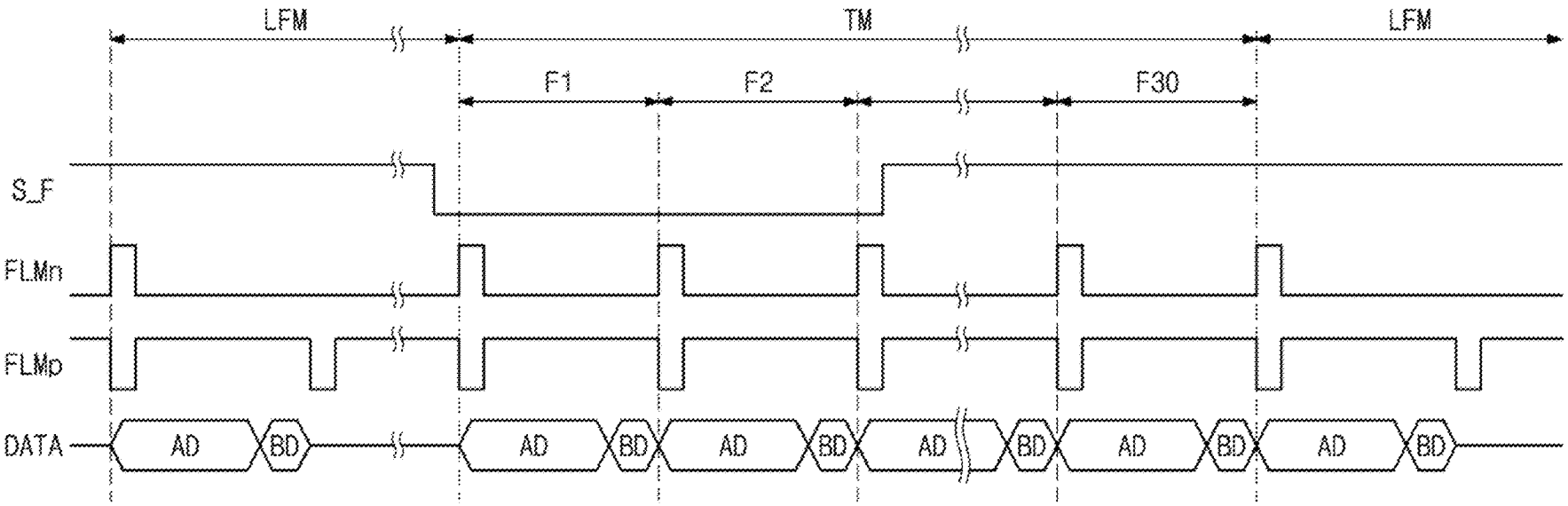
FIG. 8 is a timing diagram for explaining an image transition mode of the display device.

FIG. 8 is a timing diagram for explaining the image transition mode of the display device.

In reference to FIGS. 5 and 8, the operation mode determination circuit 240 outputs the mode signal MD of the low frequency mode LFM, when the still image flag signal S_F indicates the active level (e.g. a high level). The control signal output circuit 250 outputs the second start control signal FLMn of the second frequency (e.g. 1 Hz) and the first start control signal FLMp of the first frequency (e.g. 60 Hz) during the low frequency mode LFM.

The blank voltage determination circuit 230 provides the blank voltage signal BV corresponding to a first gray scale to the image conversion circuit 210 during the low frequency mode LFM. The image conversion circuit 210 generates blank data BD corresponding to the blank voltage signal BV.

The image conversion circuit 210 outputs the image data signal DATA including active data AD and the blank data BD to the data driving circuit 400 (shown in FIG. 1) during the low frequency mode LFM.

The data driving circuit 400 (shown in FIG. 1) may provide a data signal corresponding to the active data AD to the data lines DL1 to DLm during the active period, and then provide the blank data BD corresponding to the first gray scale to the data lines DL1 to DLm during the blank period.

On the other hand, when the image signal RGB of the current frame is different from an image signal RGB of a previous frame, the still image determination circuit 220 changes the still image flag signal S_F to the inactive level (e.g. a low level).

After the still image flag signal S_F is changed from the active level to the inactive level, the operation mode determination circuit 240 outputs the mode signal MD indicating the image transition mode TM for a prescribed time (e.g. 30 frames). During the image transition mode TM, from a first frame F1 to a 30th frame F30, frequencies of the first start control signal FLMp and the second start control signal FLMn are the first frequency (e.g. 60 Hz). In the present embodiment, the operation mode determination circuit 240 maintains the image transition mode TM for 30 frames, but the embodiment of the inventive concept is not limited thereto. For example, the maintaining time of the image transition mode TM may be changed in various ways. In addition, during the image transition mode TM, the frequencies of the first start control signal FLMp and the second start control signal FLMn may be set to another frequency (e.g. 30 Hz) higher than that of the low frequency mode LFM.

The blank voltage determination circuit 230 provides, to the image conversion circuit 210, the blank voltage signal BV corresponding to a second gray scale (e.g, the white gray scale) during the image transition mode TM. The image conversion circuit 210 generates the blank data BD corresponding to the blank voltage signal BV.

When the still image flag signal S_F indicates the active level at the last frame of the image transition mode TM, namely, at the time when the operation of the 30th frame F30 is completed, the operation mode determination circuit 240 outputs the mode signal MD indicating the low frequency mode LFM. When the mode signal MD indicates the low frequency mode LFM again, the blank voltage determination circuit 230 outputs the blank voltage signal BV corresponding to the first gray scale.

When the still image flag signal S_F indicates the inactive level at the last frame of the image transition mode TM, namely, at the time when the operation of the 30th frame F30 is completed, the operation mode determination circuit 240 outputs the mode signal MD indicating the normal frequency mode NFM.

Figure 9:
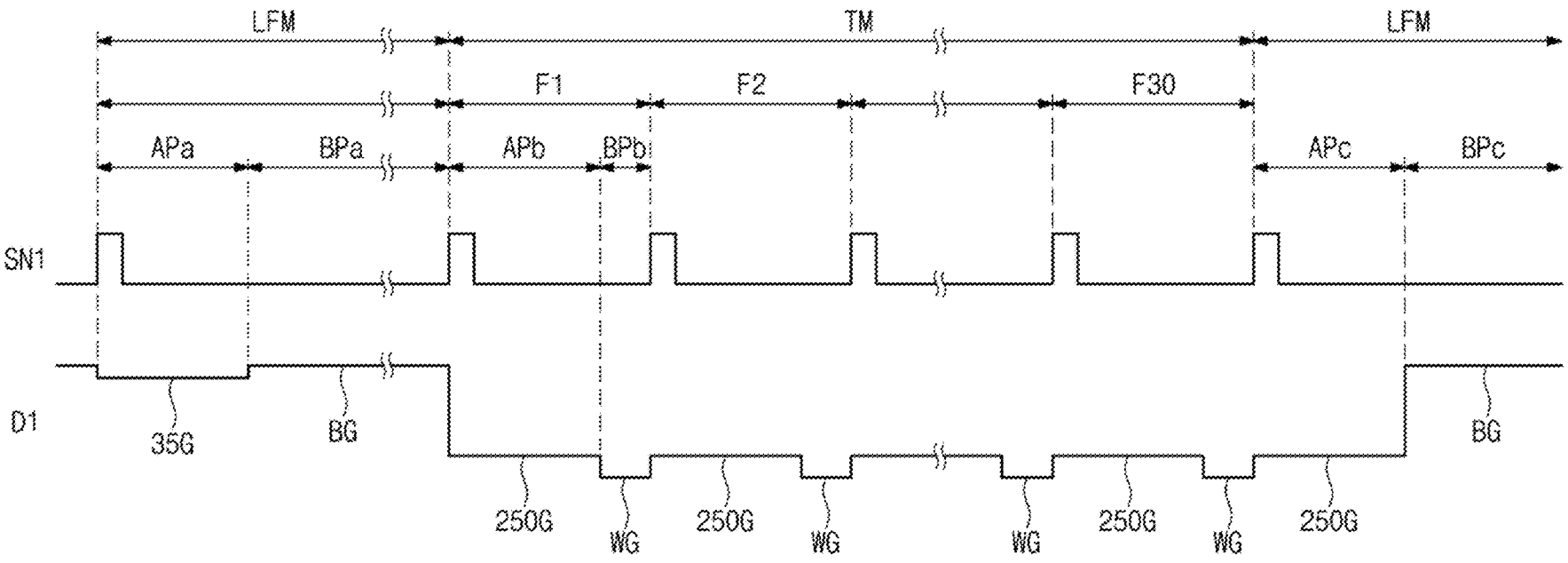
FIG. 9 is a timing diagram illustrating an example of a scan signal provided to a second type scan line and a data signal provided to a data line.

FIG. 9 is a timing diagram illustrating an example of the scan signal provided to the second type scan line and the data signal provided to the data line.

For convenience of explanation, FIG. 9 illustrates the scan signal SN1 provided to the second type scan line SNL1 and the data signal D1 provided to the data line DL1, which are shown in FIG. 1, but the embodiment of the inventive concept is not limited thereto.

In reference to FIG. 9, in an active period APa of the low frequency mode LFM, the data signal D1 to be provided to the data line DL1 has 35 gray scales 35G, and the data signal D1 to be provided to the data line DL1 in a blank period BPa has the black gray scale BG.

The data signal D1 to be provided to the data line DL1 in an active period APb of the image transition mode TM has 250 gray scales 250G, and the data signal D1 to be provided to the data line DL1 in a blank period BPb has the white gray scale WG.

After a change from the image transition mode TM to the low frequency mode LFM, the data signal D1 provided to the data line DL1 in the active period APc has 250 gray scales 250G, and the data signal D1 provided to the data line DL1 in the blank period BPc has the black gray scale BG.

When an image transition occurs in the low frequency mode a pixel should display an image of the changed gray scale, but an afterimage may be generated by the hysteresis characteristic of the first transistor T1 described above in reference to FIG. 4

For example, when only one frame image is changed, such as a change in a clock number, and a still image is received again, the still image flag signal S_F output from the still image determination circuit 220 may be changed to the active level, the inactive level, and then the active level in a unit of one frame. In this case, if the image transition mode TM is not present, an afterimage caused by an image of a previous frame may be recognized by a user. In addition, when an image of low gray scales is displayed and then the image is transitioned to an image of high gray scales in the low frequency mode LFM, a flicker caused by a luminance difference is more easily recognized.

Thus, according to the inventive concept, when the still image flag signal S_F is changed from the active level to the inactive level, operations are performed in the image transition mode TM for a prescribed time (e.g. 30 frames) to minimize the afterimage.

Figure 10A:
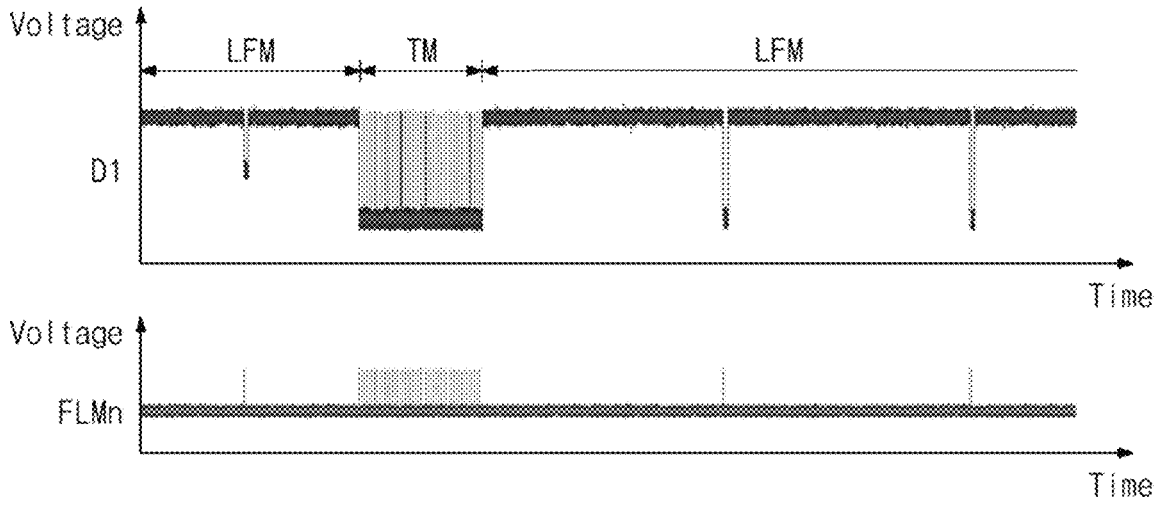
FIG. 10A illustrates a data signal and a second start control signal provided to the data line.
Figure 10B:
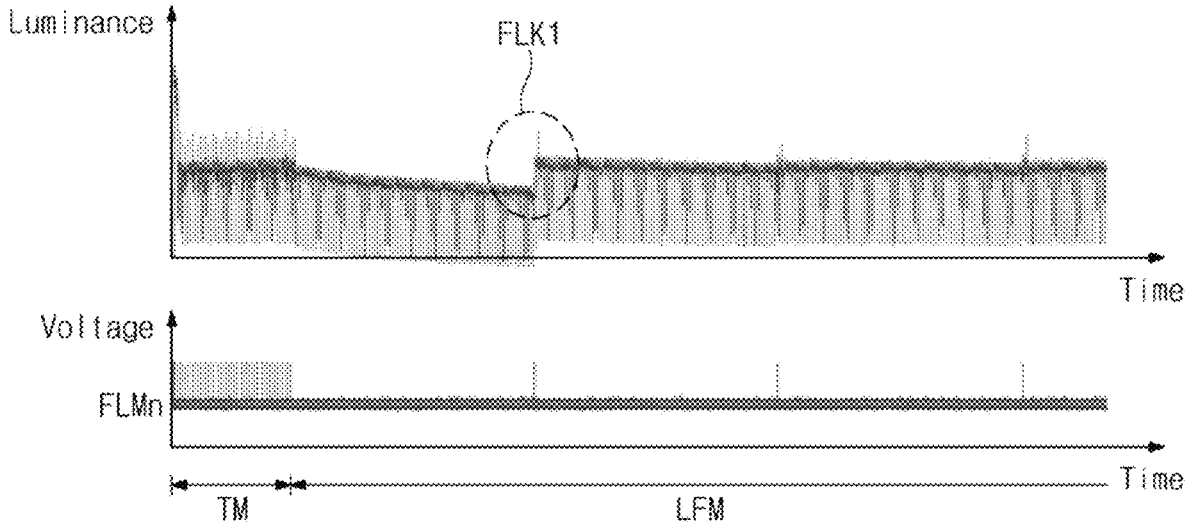
FIG. 10B illustrates a light amount measurement result of a display panel, when the data signal shown in FIG. 10A is provided to the display panel.

FIG. 10A illustrates the data signal and the second start control signal provided to the data line. FIG. 10B illustrates a light amount measurement result of the display panel, when the data signal shown in FIG. 10A is provided to the display panel.

In reference to FIGS. 10A and 10B, the data driving circuit 400 (shown in FIG. 1) may provide a data signal, which corresponds to the active data AD (shown in FIG. 8) during an active period, to the data lines DL1 to DLm, and then provide the blank data BD (shown in FIG. 8) to the data lines DL1 to DLm during a blank period.

When the blank data BD corresponds to the black gray scale in the low frequency mode LFM, the data signal D1 to be provided to the data line DL1 may have about 7.9 V. In addition, when the blank data BD corresponds to the black gray scale in the image transition mode TM, the data signal D1 to be provided to the data line DL1 may have about 7.9 V.

In other words, when the blank data BD corresponds to the black gray scale in both the low frequency mode LFM and the image transition mode TM, a flicker FLK1 caused by the luminance difference occurs after a change from the image transition mode TM to the low frequency mode LFM.

Figure 11A:
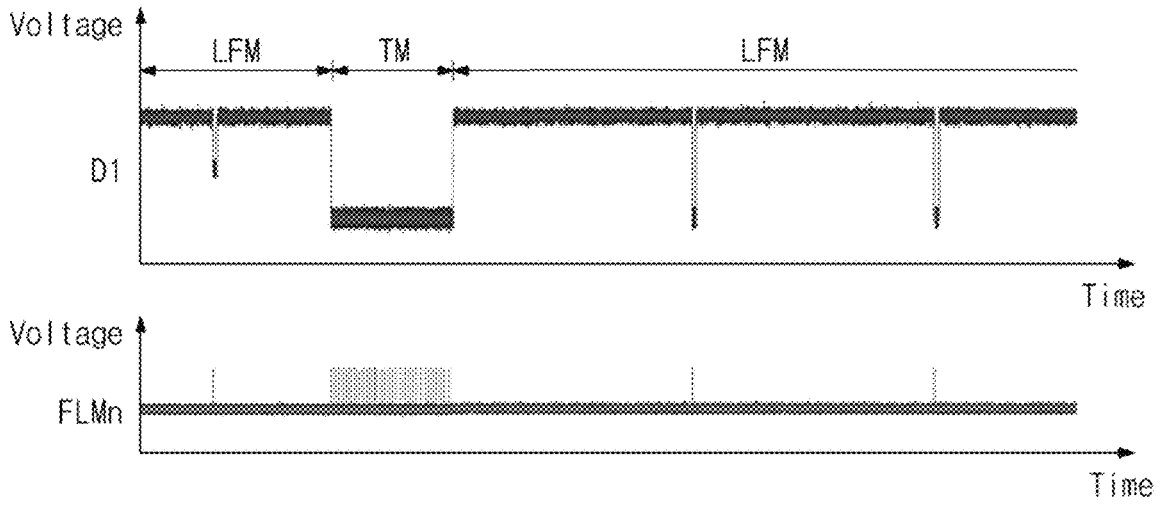
FIG. 11A shows the data signal and the second start control signal provided to the data line according to embodiments of the inventive concept.
Figure 11B:
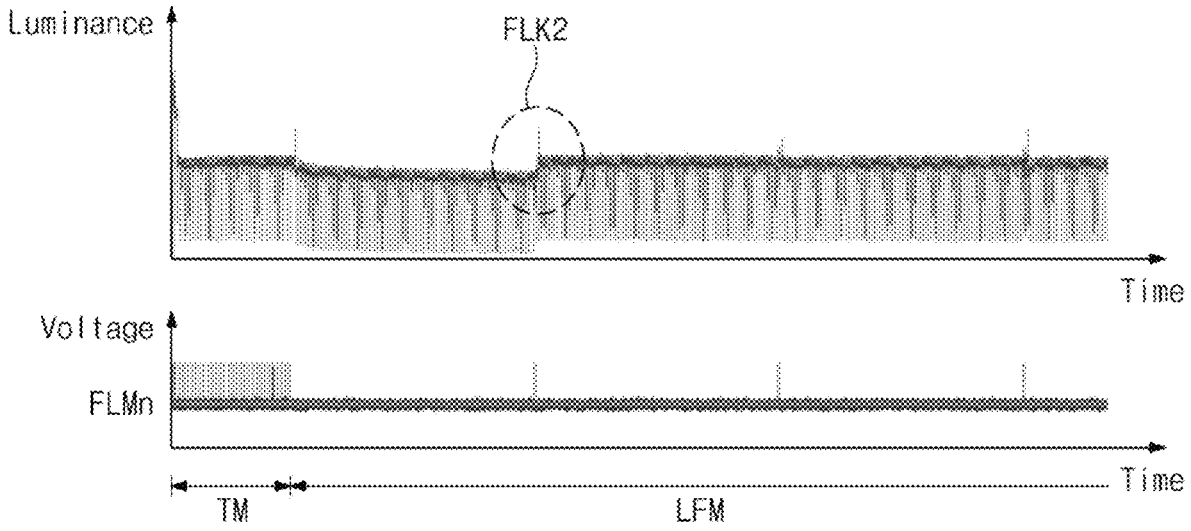
FIG. 11B shows a light amount measurement result of the display panel when the data signal shown in FIG. 11A is provided to the display panel.

FIG. 11A shows the data signal and the second start control signal provided to the data line according to embodiments of the inventive concept, and FIG. 11B shows a light amount measurement result of the display panel when the data signal shown in FIG. 11A is provided to the display panel.

In reference to FIGS. 11A and 11B, when the blank data BD corresponds to the black gray scale in the low frequency mode LFM, the data signal D1 to be provided to the data line DL1 may have about 7.9 V. In addition, when the blank data BD corresponds to the white gray scale in the image transition mode LFM, the data signal D1 to be provided to the data line DL1 may have about 3.9 V It may be understood that after the image transition mode TM is changed to the low frequency mode LFM, the flicker FLK2 caused by the luminance difference is reduced compared to that the flicker FLK1 of FIG. 10B. In other words, by implementing the white gray scale for the blank data BD during the image transition mode TM, the luminance difference upon switching from image transition mode TM to low frequency mode LFM is reduced, thus reducing flicker.

Thus, a driving controller having the above-described configuration may reduce power consumption by operating in a low frequency mode, in which the driving frequency is lowered, when a still image is input. The driving controller may prevent an afterimage from being displayed on a display image by operating in an image transition mode, in which the driving frequency is increased, when an image transition is sensed in the low frequency mode. Finally, during a blank period in the image transition mode, a voltage level of the data signal provided to the data lines is changed to a white gray scale voltage level to minimize a flicker phenomenon.

Although the exemplary embodiments of the present disclosure have been described, it is understood that the present disclosure should not be limited to these exemplary embodiments but various changes and modifications can be made by one ordinary skilled in the art within the spirit and scope of the present disclosure as hereinafter claimed. In addition, embodiments disclosed in the inventive concept are not intended to limit the technical spirit of the inventive concept, and the protection scope of the present disclosure should be interpreted based on the following appended claims and it should be appreciated that all technical spirits included within a range equivalent thereto are included in the protection scope of the present disclosure.

What is claimed is:

1. A driving controller comprising:

an image conversion circuit configured to convert an image signal received externally to an image data signal comprising active data and blank data;

a still image determination circuit configured to output a flag signal of an active level when the image signal is a still image;

an operation mode determination circuit configured to output an operation mode signal indicating a low frequency mode when the flag signal is the active level, and to output the operation mode signal indicating an image transition mode when the flag signal is changed from the active level to an inactive level; and a blank voltage determination circuit configured to receive the operation mode signal and output a blank voltage signal to the image conversion circuit, wherein the blank voltage signal corresponds to a first gray scale during the low frequency mode, the blank voltage signal corresponds to a second gray scale that is different from the first gray scale during the image transition mode, and the blank data corresponds to the blank voltage signal.

2. The driving controller of claim 1, wherein the image conversion circuit outputs the image data signal at a driving frequency corresponding to the operation mode signal.

3. The driving controller of claim 2, wherein a driving frequency in the image transition mode is higher than a driving frequency in the low frequency mode.

4. The driving controller of claim 1, wherein the operation mode determination circuit outputs the operation mode signal indicating the image transition mode for a prescribed time after the flag signal is changed from the active level to the inactive level, and outputs the operation mode signal indicating the low frequency mode when the flag signal is the active level after passage of the prescribed time.

5. The driving controller of claim 1, wherein the first gray scale is a black gray scale, and the second gray scale is a white gray scale.

6. The driving controller of claim 1, further comprising:

a control signal output circuit configured to output a first start control signal and a second start control signal in response to a control signal received externally and the operation mode signal.

7. The driving controller of claim 6, wherein frequencies of the first start control signal and the second start control signal are different from each other during the low frequency mode, and the frequencies of the first start control signal and the second start control signal are identical during the image transition mode.

8. A display device comprising:

a display panel comprising a plurality of pixels respectively connected to a plurality of data lines and a plurality of scan lines;

a driving controller configured to receive an image signal and output an image data signal, a data control signal and a scan control signal;

a data driving circuit configured to drive the plurality of data lines in response to the image data signal and the data control signal; and a scan driving circuit configured to drive the plurality of scan lines in response to the scan control signal, wherein the driving controller comprises:

an image conversion circuit configured to convert an image signal received externally to an image data signal comprising active data and blank data;

a still image determination circuit configured to output a flag signal of an active level, when the image signal is a still image;

an operation mode determination circuit configured to output an operation mode signal indicating a low frequency mode, when the flag signal is the active level, and to output the operation mode signal indicating an image transition mode, when the flag signal is changed from the active level to an inactive level; and a blank voltage determination circuit configured to receive the operation mode signal and output a blank voltage signal to the image conversion circuit, wherein the blank voltage signal corresponds to a first gray scale during the low frequency mode, the blank voltage signal corresponds to a second gray scale that is different from the first gray scale during the image transition mode, and the blank data corresponds to the blank voltage signal.

9. The display device of claim 8, wherein the image conversion circuit outputs the image data signal at a driving frequency corresponding to the operation mode signal.

10. The display device of claim 9, wherein the driving frequency in the image transition mode is higher than that in the low frequency mode.

11. The display device of claim 8, wherein the operation mode determination circuit outputs the operation mode signal indicating the image transition mode for a prescribed time after the flag signal is changed from the active level to the inactive level, and outputs the operation mode signal indicating the low frequency mode, when the flag signal is the active level after passage of the prescribed time.

12. The display device of claim 8, wherein the first gray scale is a black gray scale, and the second gray scale is a white gray scale.

13. The display device of claim 8, wherein at least one of the plurality of pixels comprises:

a light emitting diode comprising an anode and a cathode;

a first transistor comprising a first electrode configured to receive a first driving voltage, a second electrode electrically connected to the anode of the light emitting diode, and a gate electrode;

a second transistor comprising a first electrode connected to a corresponding data line among the plurality of data lines, a second electrode connected to the first electrode of the first transistor, and a gate electrode configured to receive a first scan signal; and a third transistor comprising a first electrode connected to the second electrode of the first transistor, a second electrode connected to the gate electrode of the first transistor, and a gate electrode configured to receive a second scan signal.

14. The display device of claim 13, wherein each of the first transistor and the second transistor is a P-type transistor, and the third transistor is an N-type transistor.

15. The display device of claim 14, further comprising:

a control signal output circuit configured to output a first start control signal and a second start control signal in response to a control signal received externally and the operation mode signal, wherein the scan control signal comprises the first start control signal and the second start control signal, and the scan driving circuit outputs a first scan signal for driving the first and second transistors in synchronization with the first start control signal, and outputs a second scan signal for driving the third transistor in synchronization with the second start control signal.

16. The display device of claim 15, wherein frequencies of the first start control signal and the second start control signal are different from each other during the low frequency mode, and the frequencies of the first start control signal and the second start control signal are identical during the image transition mode.

17. The display device of claim 13, wherein each of the first transistor and the second transistor is a low-temperature polycrystalline silicon (LTPS) semiconductor transistor, and the third transistor is an oxide semiconductor transistor.

18. A driving method of a display device, the driving method comprising:

determining whether an image signal is a still image;

outputting a flag signal of an active level, when the image signal is the still image;

outputting an operation mode signal indicating a low frequency mode, when the flag signal is the active level;

outputting the operation mode signal indicating an image transition mode, when the flag signal is changed from the active level to an inactive level;

outputting a blank voltage signal corresponding to the operation mode signal; and converting an image signal received externally to an image data signal comprising active data and blank data in response to the operation mode signal and the blank voltage signal, wherein the blank voltage signal corresponds to a first gray scale during the low frequency mode, the blank voltage signal corresponds to a second gray scale that is different from the first gray scale during the image transition mode, and the blank data corresponds to the blank voltage signal.

19. The driving method of claim 18, wherein, in the outputting of the operation mode signal, after the flag signal is changed from the active level to the inactive level, the operation mode signal indicating the image transition mode is output for a prescribed time, and when the flag signal is the active level after passage of the prescribed time, the operation mode signal indicating the low frequency mode is output.

20. The driving method of claim 18, wherein a driving frequency of the image transition mode is higher than that of the low frequency mode, and the first gray scale is a black gray scale and the second gray scale is a white gray scale.

* * * * *